US008931724B2

(12) United States Patent
Jordan et al.

(10) Patent No.: US 8,931,724 B2
(45) Date of Patent: Jan. 13, 2015

(54) DEVICE FOR HANDLING SPOOL OF WINDABLE MATERIAL

(71) Applicants: Michael C. Jordan, Knoxville, TN (US); David S. Jordan, Knoxville, TN (US)

(72) Inventors: Michael C. Jordan, Knoxville, TN (US); David S. Jordan, Knoxville, TN (US)

(73) Assignee: iTool Equipment Holding LLC, Knoxville, TN (US)

( * ) Notice: Subject to any disclaimer, the term of this patent is extended or adjusted under 35 U.S.C. 154(b) by 0 days.

(21) Appl. No.: 13/694,086

(22) Filed: Oct. 30, 2012

(65) Prior Publication Data

US 2014/0117143 A1 May 1, 2014

(51) Int. Cl.
*B65H 75/40* (2006.01)
*B65H 49/38* (2006.01)

(52) U.S. Cl.
CPC ..... *B65H 49/38* (2013.01)
USPC ..... 242/403; 242/595.1

(58) Field of Classification Search
CPC ..... B65H 49/24; B65H 54/42; B65H 49/32; B65H 49/34; B62B 2202/025
USPC ..... 242/595, 595.1, 557, 403
See application file for complete search history.

(56) References Cited

U.S. PATENT DOCUMENTS 2,207,663 A * 7/1940 Glasner ..... 242/420.1
2,512,324 A * 6/1950 Hall ..... 254/134.3 FT
2,565,740 A * 8/1951 Robertson et al. ..... 242/559
2,660,381 A * 11/1953 Friedl et al. ..... 242/557
2,679,987 A * 6/1954 Saliba ..... 242/393
2,834,558 A * 5/1958 Halpin ..... 242/527.5
2,904,273 A * 9/1959 Turner, Jr. et al. ..... 242/470
2,958,478 A * 11/1960 Petersen et al. ..... 242/393
3,006,570 A * 10/1961 Boser ..... 242/578
3,103,322 A * 9/1963 Garner ..... 242/470
4,085,904 A * 4/1978 McElroy ..... 242/564
4,454,999 A * 6/1984 Woodruff ..... 242/388.7
4,781,335 A * 11/1988 Compagnon ..... 242/470
5,188,308 A * 2/1993 Tussing ..... 242/557
5,687,928 A * 11/1997 Lassiter ..... 242/557
5,956,990 A * 9/1999 Ginzburg ..... 72/148
6,059,220 A * 5/2000 Lassiter ..... 242/557
6,494,397 B1 * 12/2002 Myklebust ..... 242/399.1
6,561,453 B1 * 5/2003 Shinga ..... 242/595.1
7,628,350 B2 * 12/2009 Dethier ..... 242/403
8,371,518 B2 * 2/2013 Factor ..... 242/557
8,398,013 B2 * 3/2013 Skalleberg ..... 242/486.2
2011/0108658 A1 * 5/2011 Factor ..... 242/594

* cited by examiner

*Primary Examiner* — Emmanuel M Marcelo
*Assistant Examiner* — Michael Gallion
(74) *Attorney, Agent, or Firm* — Michael E. McKee

(57) ABSTRACT

A device for handling a spool having a barrel about which a wire or cable is wound and two flanges at each end of the barrel includes a pair of wheeled carriers wherein each carrier includes an elongated frame having two opposite end portions and wherein the opposite end portions of the frame are adapted to be moved toward and away from one another. A roller is rotatably supported at each end portion of each frame and is arranged so that the rotational axis of the two rollers of each frame are substantially parallel to one another, and a screw jack is incorporated within each frame for moving the rollers of each frame toward one another so that by positioning each carrier of the device adjacent a corresponding flange of the spool and then moving the end portions of the carrier toward one another, the flange of spool is raised to an elevated condition above the floor.

17 Claims, 5 Drawing Sheets

DEVICE FOR HANDLING SPOOL OF WINDABLE MATERIAL

The benefit of Provisional Application Ser. No. 61/553,856, filed Oct. 31, 2011, and entitled A MATERIAL LIFTING, HANDLING AND PAYOUT DEVICE FOR COILED, SPOOLED AND CYLINDRICAL MATERIALS, is hereby claimed. The disclosure of this referenced provisional patent application is incorporated herein by reference.

BACKGROUND OF THE INVENTION

This invention relates generally to material handling equipment and relates, more particularly, to equipment used to lift and maneuver a spool of material, such as wire or cable, which is wound about the spool.

Heretofore and at a construction job site, a relatively large piece of equipment, such as a crane or a forklift, has been commonly required for lifting or maneuvering a large spool of coiled wire or cable between two locations. However, such a relatively large piece of equipment is typically too large to maneuver such a spool through a relatively confined area, such as a hallway or room of a building. Consequently and in order to maneuver one of these spools of wound material through such a small area (and thereby position the spool as close to the installation location as is possible), manual manipulation of the spool through such an area is commonly required. Of course, such a manual task is laborious, time-consuming and may pose a risk of injury to the individuals required to manually manipulate the spool.

It would be desirable to provide a relatively compact device which is capable of lifting a spool of material wound thereabout from the floor and which facilitates the movement of the spool through a relatively confined area.

Accordingly, it is an object of the present invention to provide a new and improved device for handling a spool of material, such as wire or cable, wound about the spool.

Another object of the present invention is to provide such a device which is capable of lifting the spool to an elevated condition above the underlying floor.

Still another object of the present invention is to provide such a device which facilitates the movement of the spool through a relatively confined space, once the spool is lifted from the floor.

Yet another object of the present invention is to provide such a device which employs a screw jack for lifting the spool from the floor.

A further object of the present invention is to provide such a device which is capable of rotating the spool about its axis, once the spool is lifted from the floor, to facilitate the unwinding of material from the spool or the winding of material about the spool.

A still further object of the present invention is to provide such a device which is capable of handling a spool within a large range of spool sizes.

One more object of the present invention is to provide such a device which is uncomplicated in structure, yet effective in operation, which resists tipping over and has a relatively high load-carrying capacity.

SUMMARY OF THE INVENTION

This invention resides in a device for handling a spool of windable material wherein the spool includes an elongated barrel about which the material is wound and two flanges at each end of the barrel and wherein each flange has a rim along the periphery thereof, and the spool is arranged so that the rims of both flanges engage an underlying floor and the barrel of the spool is oriented substantially parallel to the floor.

The device includes a pair of wheeled carriers wherein each carrier includes an elongated frame having two opposite end portions and floor-engaging wheels for supporting the frame above the floor. The device further includes four rollers for rollably engaging the rims of the flanges of the spool wherein two of the four rollers are supported for rotation on the opposite end portions of one of the pair of carriers and the other two of the four rollers are supported for rotation on the opposite end portions of the other of the pair of carriers. Furthermore, the rollers of each carrier are mounted for rotation about parallel axes so that each carrier can be positioned upon the floor and adjacent a corresponding flange of the spool so that the rollers of each carrier are positioned on opposite sides of the flange. The device further includes means for moving the rollers of each carrier toward one another and into engagement with the rim of the corresponding flange and for lifting the flange to an elevated condition above the floor as the rim of the flange is squeezed between the rollers of the carrier so that upon raising both flanges of the spool to an elevated condition, the spool can be moved across the floor as the wheels of the carrier are rolled across the floor.

DETAILED DESCRIPTION OF AN ILLUSTRATIVE EMBODIMENT

Figure 1:
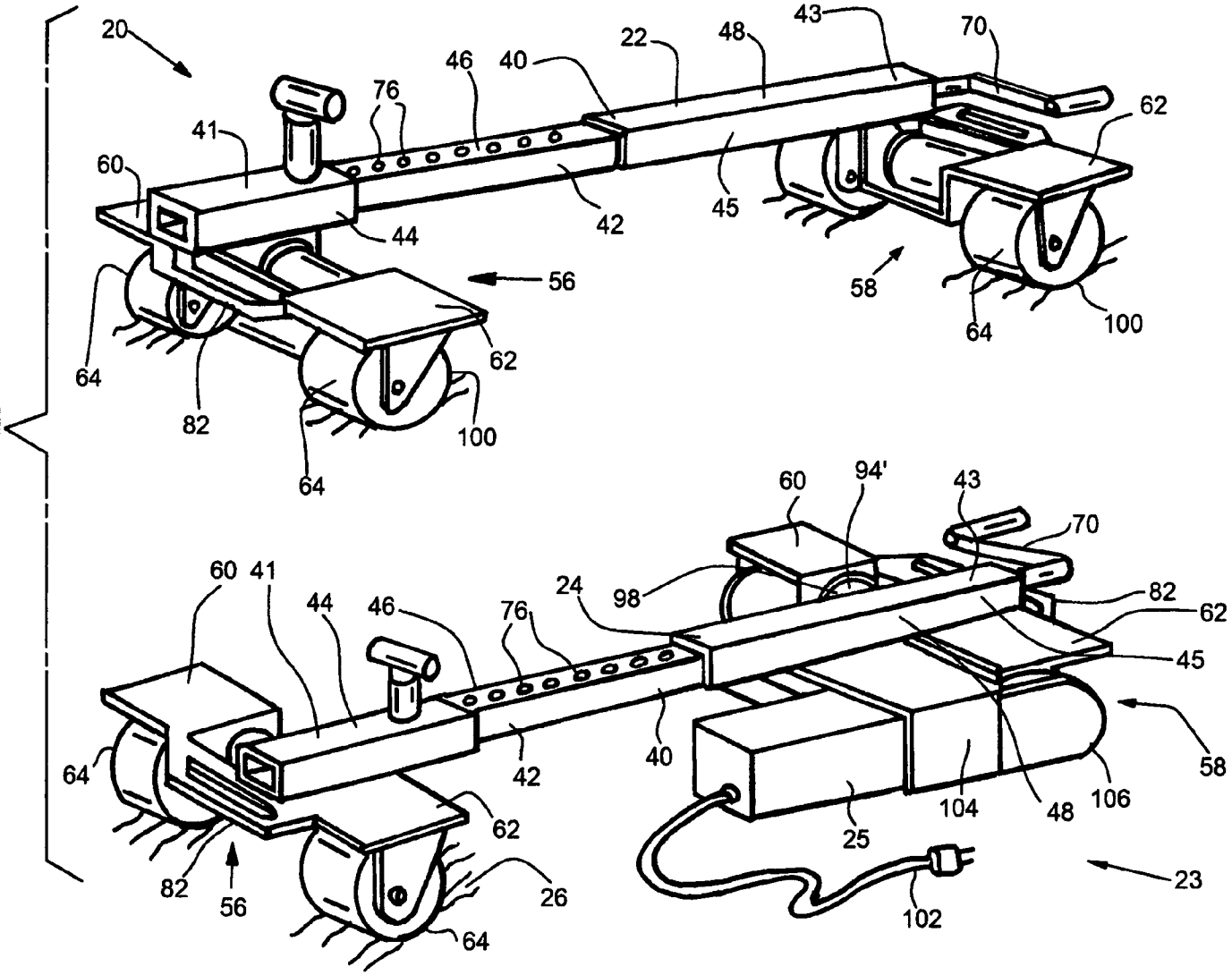
FIG. 1 is a perspective view of a two-carrier device within which features of the invention are embodied.

Turning now to the drawings in greater detail and considering first FIG. 1, there is illustrated an embodiment of a material handling device, generally indicated 20, within which features of the present invention are embodied. The device 20 includes a pair of elongated wheeled carriers 22, 24 which are used to lift a spool 30 (FIG. 2) of wound material, such as electrical wire or cable, to an elevated condition above a floor 26 so that the spool 30 can be moved between locations at a job site as a user pushes the spool 30 across the floor 26. Once the spool 30 is situated at a location at which the material which is wound about the spool 30 is desired to be unwound, a drive motor 25 associated with the wheeled carrier 22 is actuated so that the spool 30 is automatically rotated about an axis.

Figure 2:
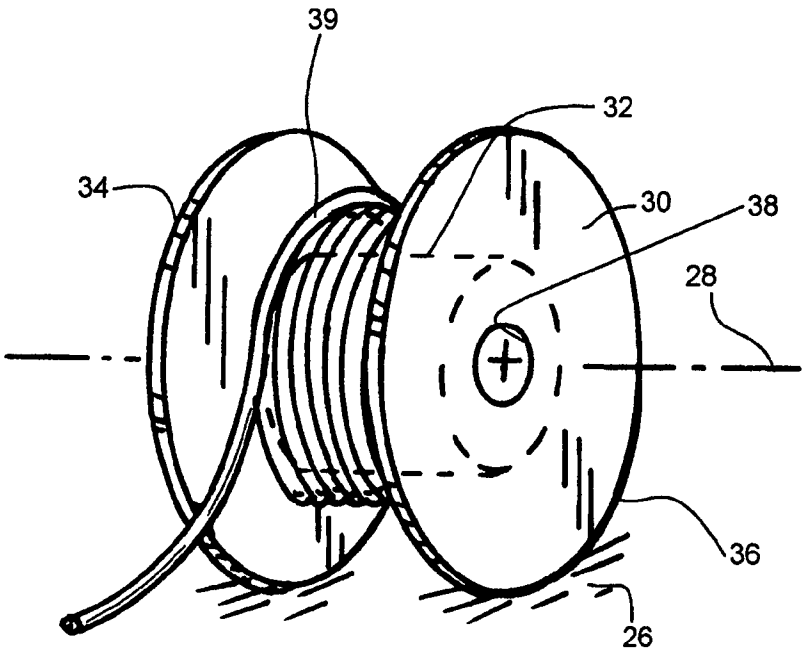
FIG. 2 is a perspective view of an exemplary spool of a class which is capable of being handled with the FIG. 1 device.

With reference to FIG. 2, there is illustrated a spool 30 of a class of spools which can be lifted, transported and rotated with the device 20. Briefly, the spool 30 includes an elongated barrel 32 about which a length of coiled material 39, such as electrical wire, steel cable, or rope, is wound and includes a pair of disc-like flanges 34, 36 attached to the opposite ends of the barrel 32. Each flange 34 or 36 is circular in form and defines a cylindrical rim 35 along its peripheral edge. Furthermore, there is commonly provided a bore 38 which extends through the center of both flanges 34, 36 and the elongated barrel 32. In addition, the bore 38 defines an elongated axis 28 about which the spool 30 is rotated with the device 20 as the material 39 which is carried by the spool 30 is unwound.

Figure 3:
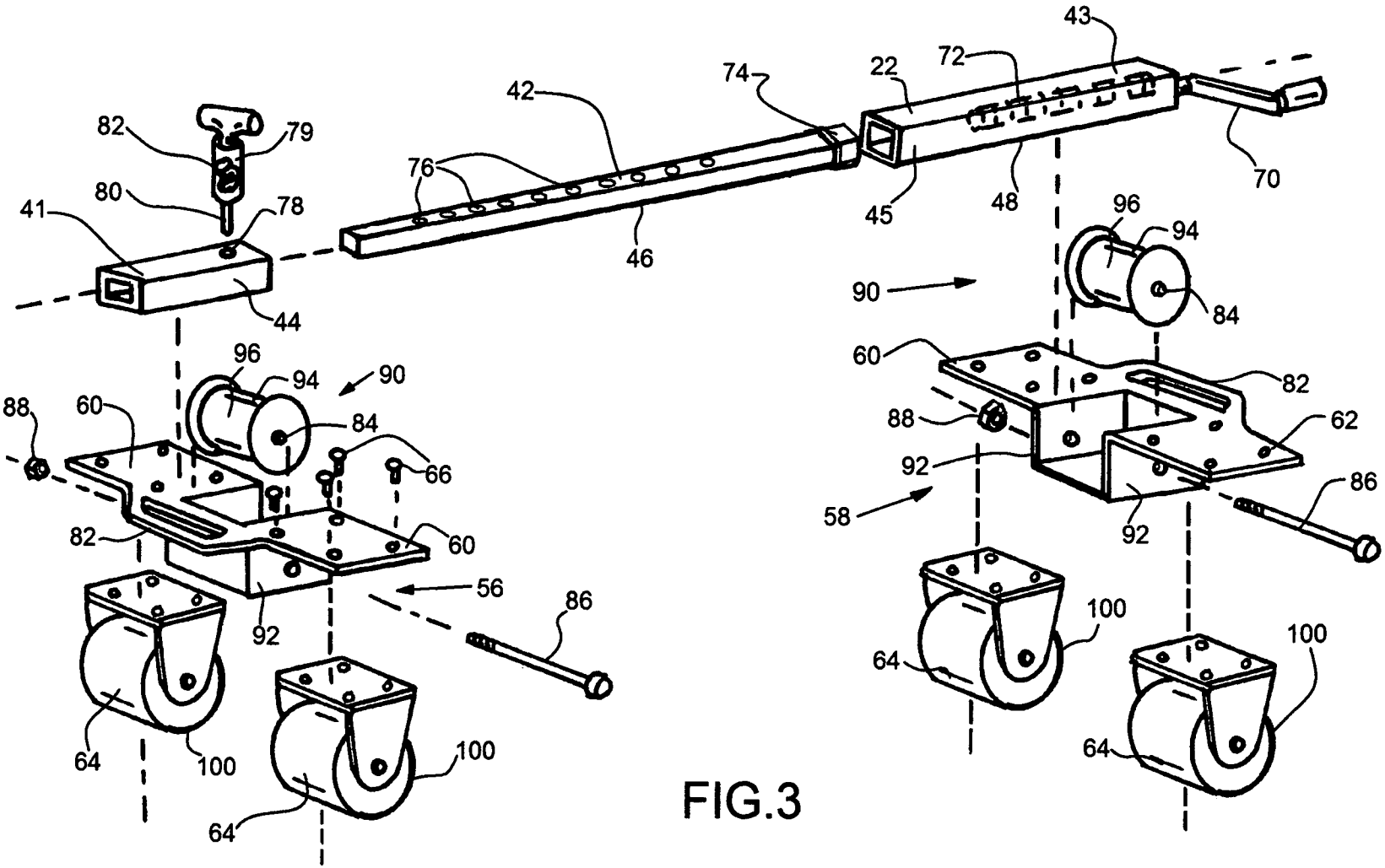
FIG. 3 is a perspective view of one of the carriers of the FIG. 1 device, shown exploded.

With reference to FIGS. 1 and 3, each of the carriers 22 or 24 includes an elongated frame 40 including two opposite end portions 41, 43 and a telescoping assembly 42 which extends between the opposite ends of the frame 40. The telescoping tube assembly 40 includes a hollow outer tube 44 and an elongated screw jack 45 comprised, in part, of a hollow inner tube 46 having an end portion which is slidably positioned within the outer tube 44. Furthermore, the jack 45 includes a tubular base 48, a rotatable handle 70 at one end of the base 48 and an internal screw member 72 which is attached to the handle 70 for cooperating with the inner tube 46 so that as an user rotates the handle 70 relative to the base 48, the internal screw member 72 cooperates with the inner tube 46 to move the tube 46 lengthwise relative to the base 48 to selectively lengthen or shorten the screw jack 45 and thus, the distance between the opposite end portions 41, 43 of the carrier 22 or 24.

The handle 70 is supported within a bearing mounted within the base 48 of the jack 45, and there is attached to the inner tube 46 an internally-threaded member 74 within which the internal screw member 72 is threaded so that rotation (e.g. manual rotation) of the screw member 72 by way of the handle 70 effects the movement of the internally-threaded member 74, and thus the inner tube 46, relative to and along the length of the base 48. It therefore follows that rotation of the handle 70 in one rotational direction relative to the base 48 lengthens the screw jack 45 (and thus the distance between the opposite end portions 41, 43 of the carrier 22 or 24), and that rotation of the handle 70 in the opposite rotational direction relative to the base 48 shortens the jack 45.

With reference still to FIG. 3, the inner tube 46 has a plurality of openings 76 defined therealong, and the outer tube 44 includes a defined opening 78 about which a hollow post 79 is attached, and a pin 80 is positioned within the post 79 for movement between lowered condition and a raised condition with respect to the tube 44. With the pin 80 positioned in a raised condition, the inner tube 46 can be slidably moved along the length of the outer tube 44 to move a desired opening 76 of the inner tube 46 into an aligned relationship (i.e. into vertical registry with) the opening 78, and the pin 80 can be then moved downwardly through the aligned openings 76, 78 to releasably secure the inner and outer tubes 44 and 46 in a desired positional relationship. Mounted within the post 79 is a spring 82 which spring-biases the pin 80 toward its lowered condition (and thus in a condition at which the inner and outer tubes 44 and 46 are locked together) so that until it is desired to lift the pin 80 to a condition of release which thereby enables the inner tube 46 to be moved relative to and along the outer tube 46, the pin 80 maintains the inner and outer tubes 44 and 46 in a locked positional relationship.

It follows from the foregoing that each of the screw jack 45 and the plurality of openings 78 of the inner tube 46 enables the overall length of each frame 22 or 24, as measured between the opposite end portions 41, 43 of the carrier 22 or 24 to be altered. More specifically, the length of each carrier 22 or 24 can be adjusted by moving the inner and outer tubes 46, 44 relative to one another so that the pin 79 is aligned with an alternative opening 78 of the inner tube 46, and the length of each carrier 22 or 24 can be adjusted further by rotating the jack handle 70 relative to the base 48. As will be apparent herein and when the device 20 is used to lift a spool 30 from the floor 26, the size of the spool 30 commonly dictates the initial positional relationship between the inner and outer tube 44 and 46, and then the screw jack 45 is used to move the carrier end portions 41 and 43 toward one another so that the spool 30 is lifted from the floor 26.

With reference still to FIGS. 1 and 3, there is associated with each end portion 41 or 43 of each carrier 22 or 24 a spool-engagement assembly 56 or 58 which supports the carrier frame 26 above the floor 26 and includes means, generally indicated 90, for engaging the rim 35 of the spool 30 during a spool-lifting operation. In this connection, each spool-engaging assembly 56 or 58 includes a pair of spaced-apart platforms 60, 62 which are arranged substantially horizontally and a pair of wheel—including casters 64 which are attached, as with screws 66, to the underside of the platforms 60, 62 so that the wheels 100 of the casters 64 support the platforms 60, 62 above the underlying floor 26 and are capable of rotating about vertical axes to permit the carriers 22 and 24 to be moved, or pushed, in any direction across the floor 26.

Meanwhile, the spool-engaging assembly 56 of each carrier 22 or 24 is connected to the carrier frame 40 adjacent one end thereof as its platform 60 is fixedly joined, as with welds, to the underside of the outer tube 44, and the spool-engaging assembly 58 is fixedly joined, as with welds, to the underside of the base 48 of the screw jack 45. If desired, the platforms 60, 62 can be formed from a single plate, and a handle 82 can be formed within this single plate to facilitate the transport of each carrier 22 from one location to another and to facilitate the manipulation of the carrier 22 or 24 into a position adjacent a corresponding flange 34 or 36 of the spool 30 in preparation of a spool-lifting operation.

Furthermore, there is disposed between the platforms 60, 62 a pair of downwardly-turned spaced-apart flanges 92, and the spool-engaging means 90 is mounted for rotation between the flanges 92. In particular, the spool-engaging means 90 includes a roller 94 which is supported for rotation between the flanges 92 for rotation about a substantially horizontal axis (i.e. an axis which is substantially parallel to the underlying floor 26). To this end, each roller 94 has a central through-opening 84 (FIG. 3), and a threaded shank 86 is directed through aligned openings provided in the flanges 92 and through-opening 84 and which is secured in place with a nut 88. While three of the four rollers 94 are capable of rotating freely about its shank 86, one of the rollers, indicated 94', is secured about the shank 86 so that the roller 94' and shank 86 must rotate together.

Each roller 94 includes a substantially cylindrical peripheral surface 96 which is adapted to engage the rim 35 of the spool 30 when the carriers 22 and 24 are placed in operative relationship therewith. While the peripheral surfaces of three rollers 94 of the depicted carriers 22, 24 are relatively smooth, the roller 94' of the carrier 22 is surrounded with an band, or coating, of elastomeric material 98 which provides the surface of the roller 94' with a high degree of frictional resistance to movement of the rim 35 therealong when the surface of the roller 94' is placed in engagement with the spool rim 35. To further enhance the surface-to-surface engagement between the roller 94' and the rims 35 of the spool 30, the profile of each roller surface 96 can be formed to substantially match, or conform to, the contour of the rim 35 intended to be engaged by the roller surface 96.

Figure 4:
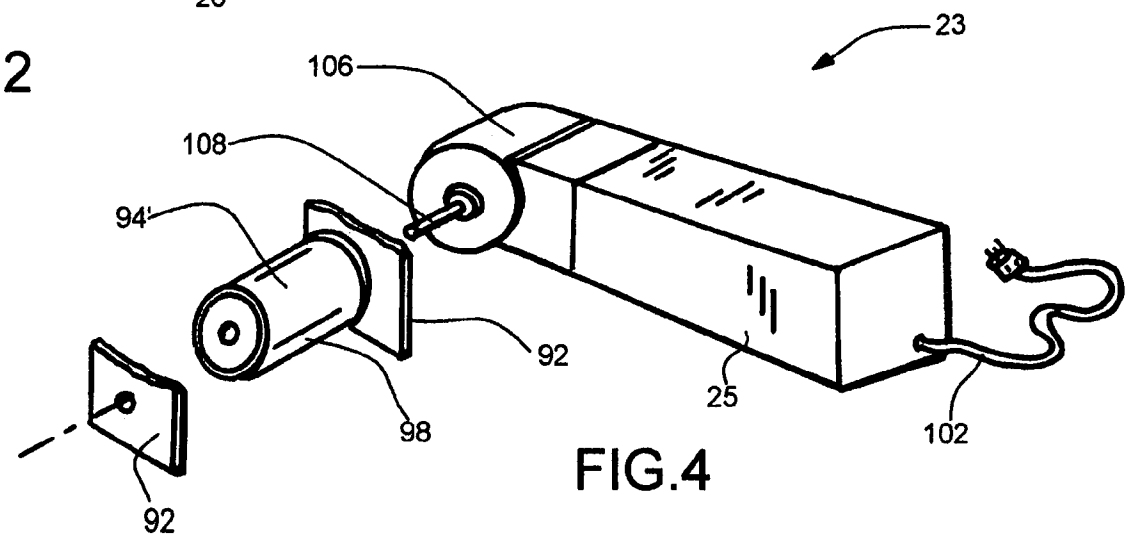
FIG. 4 is a perspective view of a fragment of the other of the two FIG. 1 carriers, shown exploded.

As best shown in FIGS. 1 and 4, the rollers 94 of each carrier 22 or 24 are arranged in a spaced-apart relationship with one another and are arranged in a spaced relationship with the underlying floor 26. Moreover, the rollers 54 of each carrier 22 or 24 are adapted to rotate about parallel axes which, in turn, are arranged generally parallel to the floor 26.

It is also feature of the device 20 that it includes means for moving, generally indicated 23, for rotating the roller 94' about its longitudinal axis. Within the depicted device 20, the moving means 23 includes the drive motor 25, introduced earlier, which is connected in driving relationship with the roller 94' (FIG. 4) for forcibly rotating the roller 94' about a rotation axis which corresponds with the longitudinal axis of the roller 94'. In this connection, the drive motor 25 (having a power cord 102) is supported from the frame 26 of the carrier 24 by means of a bracket 104 and whose shaft is drivingly connected, by way of a gear box 106 and drive shaft 108, to the roller 94' or, more specifically, to the shank 86 which extends through the roller 94'. As will be apparent herein, once the spool 30 is supported upon the rollers 94 in an elevated condition above the floor 26, the drive motor 25 can be actuated to rotate the spool 30 about its axis 28 by way of the roller 94'.

Figure 5:
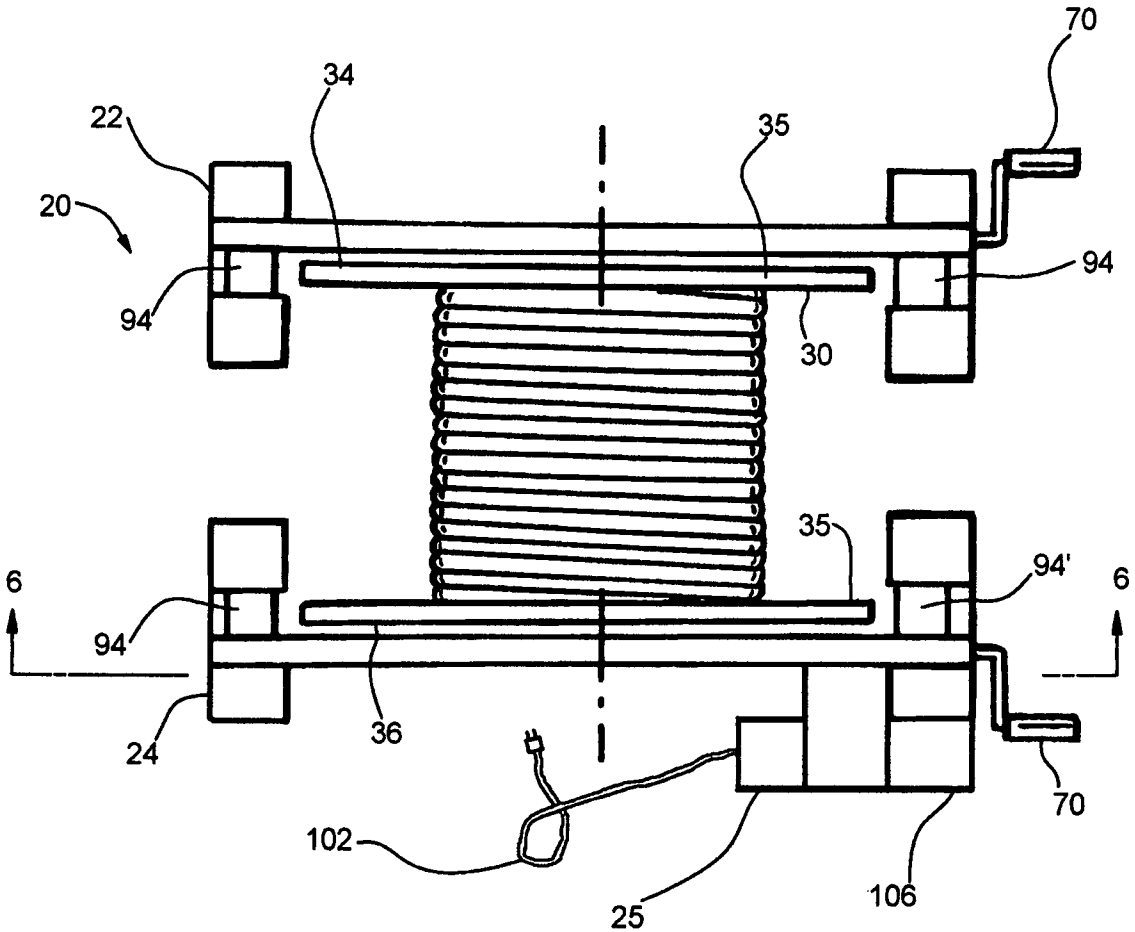
FIG. 5 is a plan view of the carriers of the FIG. 1 device and the FIG. 2 spool as seen from above and which illustrates schematically the positioning of the carriers adjacent the flanges of the spool for a spool-lifting operation.
Figure 6:
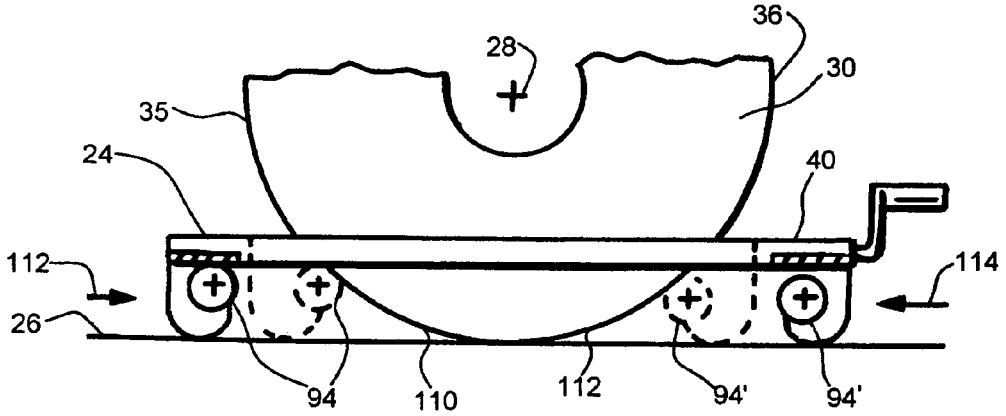
FIG. 6 is a fragmentary cross-sectional view taken about along lines 6-6 of FIG. 5 which illustrates the position of the rollers of the device in relation to the flanges of the FIG. 2 spool when the device is positioned adjacent the flanges for the purpose of lifting the spool from the floor.
Figure 7:
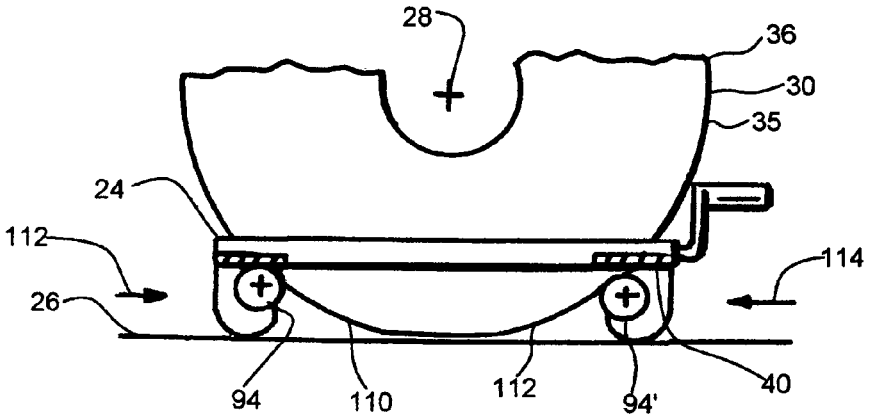
FIG. 7 is a view similar to that of FIG. 6 but illustrating the spool after it has been lifted to an elevated position above the floor with the device.

With reference to FIGS. 5-7 and to use the device 20 to lift and maneuver a spool 30 across the floor 26, each carrier 22 or 24 is arranged adjacent a corresponding flange 34 or 36 of the spool 30 so that the rollers 94 are disposed in registry with the flange 26 or 28 so that subsequent movement of the rollers 94 toward one another move the surfaces 96 of the rollers 94 into engagement with the surfaces of the rim 35 of the flange 26 or 28 on opposite sides of the center thereof. To this end and to ensure that the carrier 22 or 24 will fit about the flange 34 or 36 for spool-lifting purposes, the handle 70 is rotated (as needed) so that the inner tube 46 extends further from the base 48 of the jack 45 (to thereby lengthen the frame 40), and then the telescoping tube assembly 42 is adjusted in length (as needed) by moving the inner and outer tubes 44 and 46 relative to one another so that when the carrier frame 40 is positioned alongside the corresponding flange 34 or 36 of the spool 30, the rollers 94 are disposed outboard of the rim 35 of the flange 34 or 36 on opposite sides thereof, as shown in FIG. 5 and as shown in the solid-line position of FIG. 6. Stated another way, the portions, indicated 110 and 112 of the rim 35 disposed adjacent the floor 26 and on opposite sides of the location at which the rim 35 engages the floor 26 are disposed between the rollers 94.

With each carrier 22 and 24 disposed adjacent a corresponding flange 24 or 26 of the spool 30 as aforedescribed, the handles 70 of the screw jacks 45 are then manually rotated to move the opposite end portions 41 and 43 of the carrier frame 40 toward one another (corresponding with the directions indicated by the pair of arrows 112, 114) so that the rollers 94 of the carriers 22, 24 are moved into engagement with the rim portions 110 and 112 (as illustrated in phantom-line position in FIG. 6) and subsequently lift the spool flanges 34 and 36 to an elevated condition above the floor 36 (as illustrated in FIG. 7) as the rim portions 110 and 112 are squeezed between the rollers 94. It will be understood that the screw jacks 45 need not be simultaneously rotated to raise the flanges 34 and 36 of the spool 30 simultaneously from the floor 26, but instead, the screw jacks 45 can be rotated one-at-a-time to raise each flange 34 or 36 one-at-a-time from the floor 26.

With the spool 30 in an elevated condition above the floor 26, the spool 30 can be pushed across the floor 26 as the wheels 100 of the casters 64 roll across the floor 26. Furthermore and since the casters 64 permit the wheels 100 thereof to pivot about vertical axes, the spool 30 can be steered, or directed, through a relatively small area or a narrow hallway, and the device 20 is advantageous in this respect.

Once the spool 30 has been moved to a desired site at which the material 39 is desired to be unwound from the spool 30, the drive motor 25 is actuated to rotate the roller 94' (FIG. 4) about its rotation axis to facilitate the unwinding of the material 39 from the spool 30. Since both flanges 34 and 36 rest upon the rollers 94 (including roller 94'), the rotation of the roller 94' in one rotational direction thereabout effects the rotation of the spool flange 36 (which rests against the roller 94') to rotate about its axis 28 in the opposite rotational direction as the other rollers 94 are rollably engaged by the roms 35 of the flange 34 or 36.

Within the device 20, the drive motor 25 is electrically-powered and preferably both variable in speed and reversible in rotational direction. Consequently, the spool 30 can be rotated about its axis 28 at a speed selected to correspond with the desired feed rate of material 39 from the spool 30 and can be rotated in either of two rotational directions to either facilitate the unwinding of material 39 from the spool 39 or facilitate the winding of material 39 about the spool 30. An example of an electric motor suitable for use as the variable-speed, reversible drive motor 25 is currently available from DEWALT Industrial Tool Co. of Baltimore, Md. under the trade designation DEWALT, Model No. DWD460. Furthermore and if desired, a hand controller (not shown) can be wired to the motor 25 to facilitate an operator's control over the motor operation.

To remove the device 20 from beneath the spool 30, the handles 70 of the screw jacks 45 are appropriately rotated to lengthen the opposite end portions 41, 43 of the carrier frames 40 so that the rollers 94 permit the spool flanges 34, 36 to return into engagement with the floor 26 and are subsequently moved far enough apart to permit each carrier 22 or 24 to be removed from its location (on the floor 26) adjacent the corresponding spool flange 34.

It follows from the foregoing that a compact and light-weight device 20 has been described which can be used to lift a spool 30 of wound material 39 from the floor 26 and enables the spool 30 to be moved (e.g. by pushing) across the floor 28 from one location to another location as the wheels 100 of the casters 64 roll across the floor 26. Once the spool 30 is positioned in a desired location at a job site, the drive motor 25 can be activated to rotate the spool 30 about its axis 28 and thereby facilitate the unwinding of the material 39 from the spool 30 or facilitate the winding of material about the spool 30. Since the device 20 does not engage or interact wtih the material 39 wound about the spool 30 during a spool-unwinding operation, the device 20 is less likely to damage the material 39 than is a spool-unwinding device which pulls upon the material wound about the spool.

By way of example; various components of the device 20 can be provided with the following dimensions: When the frame 40 of each carrier 22 or 24 is collapsed to its shortest length, the rollers 94 of each carrier are about 15.5 inches apart (as measured from roller center to roller center); and when the frame 40 of each carrier 22 or 24 is lengthened to its longest length, the rollers 94 of each carrier are about 33.0 inches apart (as measured from roller center to roller center). Furthermore, the center of each roller 94 is about 4.0 inches from the underlying floor 26, and the height of each caster 64 (as measured from the floor 26) is about 5.25 inches.

It has been found that a device 20 embodying the aforediscussed features is capable of lifting from the floor (for subsequent maneuvering thereacross) a spool whose diameter falls within the range of between about 1.5 feet and about six feet. Moreover, the device 20 is capable of lifting a spool 30 weighing up to five thousand pounds, cannot easily be tipped over and does not have to be anchored in place when used to lift a spool 30.

It will be understood that numerous modifications and substitutions can be had to the aforedescribed embodiment 20 without departing from the spirit of the invention. Accordingly, the aforedescribed embodiment 20 is intended for the purpose of illustration and not as limitation.

The invention claimed is:

1. A device for handling a spool of windable material wherein the spool includes an elongated barrel about which the material is wound and two flanges wherein each flange is disposed at each end of the barrel and has a rim along the periphery thereof and the spool is arranged so that the rims of both flanges engage an underlying floor and the barrel of the spool is oriented substantially parallel to the floor, said device comprising:

a pair of wheeled carriers wherein each carrier includes an elongated frame having two opposite end portions and floor-engaging wheels for supporting the frame above the underlying floor;

four rollers for rollably engaging the rims of the flanges of the spool wherein two of the four rollers are supported for rotation on the opposite end portions of one of the pair of carriers and the other two of the four rollers are supported for rotation on the opposite end portions of the other of the pair of carriers and wherein the two rollers of each carrier are mounted for rotation about parallel axes so that each carrier can be positioned upon the floor and adjacent a corresponding flange of the two flanges of the spool so that the two rollers of each carrier are positioned on opposite sides of the corresponding flange and wherein the two rollers of each carrier are mounted for movement toward one another along a path of movement which is substantially normal to the rotational axis of each of the two rollers of the carrier; and means for moving the two rollers of each carrier toward one another along said path of movement and into engagement with the rim of the corresponding flange of the two flanges and for lifting the corresponding flange to an elevated condition above the floor as the two rollers of the carrier are moved toward one another along said path of movement and the rim of the corresponding flange is thereby squeezed between the two rollers of the carrier so that upon raising both of the two flanges of the spool to an elevated condition by squeezing each of the two flanges between the two rollers of a corresponding carrier as aforesaid, the spool can be moved across the floor as the wheels of the carriers are rolled across the floor;

wherein the two opposite end portions of the frame of each carrier are adapted to be moved toward and away from one another for altering the distance between the two rollers suported by the carrier so that by moving the two opposite end portions of the frame of each carrier toward and away from one another, the distance between the two rollers supported by each carrier is altered accordingly and the length of the elongated frame is altered accordingly; and wherein the frame of each carrier includes a tube assembly having a longitudinal axis and including telescoping tube sections which are arranged for movement relative to one another along the longitudinal axis of the tube assembly so that as the opposite end portions of the frame of a carrier are moved toward or away from one another, the telescoping tube sections are moved relative to one another along the longitudinal axis of the tube assembly and guide the movements of the opposite end portions of the frame toward and away from one another.

2. The device as defined in claim 1 wherein each carrier includes a screw jack assembly which is incorporated within the frame of the carrier for moving the opposite end portions of the frame of the carrier toward or away one another.

3. The device as defined in claim 2 wherein the screw jack assembly includes a manually-operable handle so that as the handle is operated by a user, the opposite end portions of the frame of a carrier are moved toward or away from one another.

4. The device as defined in claim 1 wherein the tube assembly includes two tube sections which are movable relative to one another along the longitudinal axis of the tube assembly to alter the positional relationship therebetween and to thereby alter the distance between the two rollers of the carrier, and the tube assembly further includes means for releaseably securing said two tube sections in a desired positional relationship therebetween.

5. The device as defined in claim 1 further comprising a motor which is supported by the frame of one of the two carriers and which is drivingly connected to one of the two rollers of said one of the two carriers so that after the spool has been raised to an elevated condition above a floor by the two carriers, actuation of the motor effects the rotation of the spool about an axis as the rim of the flange is rotated by the rotation of said one of the two rollers.

6. The device as defined in claim 5 wherein the motor is a variable speed motor which permits a user to adjust the speed of rotation of the spool.

7. The device as defined in claim 5 wherein the motor is reversible to permit a user to rotate the spool about an axis in either of two rotational directions.

8. A device for handling a spool having an elongated barrel about which a material can be wound and two flanges wherein each flange is disposed at each end of the barrel and has a rim along the periphery thereof and the spool is arranged upon an underlying floor so that the rims of both flanges rest upon the floor and the longitudinal axis of the barrel of the spool is oriented substantially parallel to the floor, said device comprising:

a pair of wheeled carriers wherein each carrier includes an elongated frame having two opposite end portions and wherein the opposite end portions of the frame are adapted to be moved toward and away from one another to accommodate an adjustment in the distance therebetween and to effect a shortening or lengthening of the elongated frame as the opposite end portions are moved toward or away from one another;

a pair of rollers which are supported by the frame of each carrier wherein one of the rollers in each pair of rollers is mounted upon one end portion of the frame and the other of the rollers in each pair of rollers is mounted upon the other end portion of the frame, and wherein the rollers of each pair of rollers are arranged for rotation about axes which are oriented substantially parallel to the underlying floor and so that the rotational axis of the rollers in each pair of rollers are substantially parallel to one another and wherein the pair of rollers supported by each carrier are mounted for movement toward and away from one another along a path of movement which is substantially normal to the rotational axis of rollers of the pair of rollers of the carrier; and means for moving the two opposite end portions of the frame of each carrier toward one another so that the pair of rollers supported by the frame of each carrier are thereby moved toward one another along said path of movement;

so that by positioning each carrier of the device adjacent a corresponding flange of the two flanges of the spool so that the surfaces of the pair of rollers supported by the carrier are disposed in operative registry with the rim of the corresponding flange on opposite sides thereof and then moving the opposite end portions of the frame of the carrier toward one another so that the pair of rollers of the carrier are moved toward one another along said path of movement, the two flanges of the spool are raised to an elevated condition above the floor as each flange of the two flanges is thereby squeezed between the pair of rollers of a corresponding carrier;

so that upon raising the two flanges of the spool to an elevated condition by squeezing each of the two flanges between the pair of rollers of a corresponding carrier as aforesaid, the spool can be moved across the floor as the wheels of the carriers are rolled across the floor; and wherein the frame of each carrier includes a tube assembly having a longitudinal axis and including telescoping tube sections which are arranged for movement relative to one another along the longitudinal axis of the tube assembly so that as the opposite end portions of the frame of a carrier are moved toward or away from one another, the telescoping tube sections are moved relative to one another along the longitudinal axis of the tube assembly and guide the movement of the opposite end portions of the frame toward or away from one another.

9. The device as defined in claim 8 wherein each carrier includes a screw jack assembly which is incorporated within the frame of the carrier for moving the opposite end portions of the frame of the carrier toward or away one another.

10. The device as defined in claim 9 wherein the screw jack assembly includes a manually-operable handle so that as the handle is operated by the user, the opposite end portions of the carrier frame are moved toward or away from one another.

11. The device as defined in claim 9 wherein the tube assembly of each frame further includes means for releasably securing its two telescoping tube sections in a desired positional relationship with respect to one another following the movement of the tube sections relative to one another along the longitudinal axis of the tube assembly.

12. The device as defined in claim 11 further comprising a motor which is supported by the frame of one of the two carriers and which is drivingly connected to one of the pair of rollers of said one of the two carriers so that after the spool has been raised to an elevated condition above a floor by the two carriers, actuation of the motor rotates said one of the pair of rollers about its rotational axis to thereby rotate the spool about an axis.

13. The device as defined in claim 12 wherein the motor is a variable speed motor which permits a user to adjust the speed of rotation of the spool.

14. The device as defined in claim 12 wherein the motor is reversible to permit a user to rotate the spool about an axis in either of two rotational directions.

15. The device as defined in claim 8 wherein each carrier includes a pair of casters disposed at each of the opposite end portions of the frame and which are arranged so that the roller which is supported by the corresponding end portion of the frame is substantially positioned between the pair of casters.

16. A device for handling a spool of windable material wherein the spool includes an elongated barrel about which the material is wound and two flanges wherein each flange is disposed at each end of the barrel and has a rim along the periphery thereof and the spool is arranged so that the rims of the two flanges engage an underlying floor and the barrel of the spool is oriented substantially parallel to the floor, said device comprising:

a pair of wheeled carriers wherein each carrier includes an elongated frame having two opposite end portions and floor-engaging wheels for supporting the frame above the floor;

a first pair of rollers for rollably engaging the rim of one flange of the spool wherein the rollers of the first pair of rollers are supported for rotation at the opposite end portions of one of the pair of carriers about rotation axes which are substantially parallel to one another and wherein the elongated frame of said one of the pair of carriers is adapted to accommodate a movement of the first pair of rollers toward and away from one another along a first path of movement which is substantially normal to the rotational axes of each roller of the first pair of rollers to thereby accommodate an adjustment in the spaced distance between the first pair of rollers;

a second pair of rollers for rollably engaging the rim of the other flange of the spool wherein the rollers of the second pair of rollers are supported for rotation at the opposite end portions of the other of the pair of carriers about rotation axes which are substantially parallel to one another and wherein the elongated frame of said other of the pair of carriers is adapted to accommodate a movement of the second pair of rollers toward and away from one another along a second path of movement which is substantially normal to the rotational axis of each roller of the second pair of rollers to thereby accommodate an adjustment in the spaced distance between the rollers of the second pair of rollers; and means for moving the first pair of rollers toward one another along said first path of movement and into engagement with the rim of one flange of the two flanges and for lifting said one flange to an elevated condition above the floor as the rollers of the first pair of rollers are moved toward one another along said first path of movement so that the rim of the one flange is squeezed between the first pair of rollers; and means for moving the second pair of rollers toward one another along said second path of movement and into engagement with the rim of the other flange of the two flanges and for lifting said other flange to an elevated condition above the floor as the rollers of the second pair of rollers are moved toward one another along said second path of movement so that the rim of the other flange is squeezed between the second pair of rollers so that by positioning each wheeled carrier adjacent a corresponding flange of the two flanges of the spool so that the pair of rollers which are supported for rotation at the opposite end portions of the carrier are positioned on opposite sides of the corresponding flange of the two flanges and in registry with the rim thereof and subsequently moving the rollers which are supported for rotation at the opposite end portions of the carrier toward one another along the corresponding first or second path of movement, each flange of the two flanges is raised to an elevated condition above the floor as the rim of the flange is squeezed between the rollers of the corresponding pair of rollers as aforesaid, the spool can be moved across the floor as the wheels of the carriers are rolled across the floor;

wherein the two opposite end portions of the frame of each carrier are adapted to be moved toward and away from one another for altering the distance between the two rollers supported by the carrier so that by moving the two opposite end portions of the frame of each carrier toward or away from one another, the distance between the two rollers supported by each carrier is altered accordingly and the length of the elongated frame is altered accordingly, and wherein the frame of each carrier includes a tube assembly having a longitudinal axis and including telescoping tube sections which are arranged for movement relative to one another along the longitudinal axis of the tube assembly so that as the opposite end portions of the frame of a carrier are moved toward or away from one another, the telescoping tube sections are moved relative to one another along the longitudinal axis of the tube assembly and guide the movement of the opposite end portions of the frame toward one another.

17. The device as defined in claim 16 further comprising a motor which is supported by the frame of one of the two carriers and which is drivingly connected to one of the two rollers of said one carrier so that after the spool has been raised to an elevated condition above a floor by the two carriers, actuation of the motor rotates said one of the two rollers about its rotational axis to thereby rotate the spool about an axis.

* * * * *